US006969063B2

(12) United States Patent
Park

(10) Patent No.: US 6,969,063 B2
(45) Date of Patent: Nov. 29, 2005

(54) PAPER-FEEDING APPARATUS HAVING A PART TO VARY A PAPER-ENTERING ANGLE IN AN IMAGE FORMING APPARATUS

(75) Inventor: Ju-hyun Park, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 10/424,942

(22) Filed: Apr. 29, 2003

(65) Prior Publication Data

US 2004/0046308 A1 Mar. 11, 2004

(30) Foreign Application Priority Data

Sep. 9, 2002 (KR) ..... 2002-54351

(51) Int. Cl.[7] ..... B65H 3/34
(52) U.S. Cl. ..... 271/167; 271/145
(58) Field of Search ..... 271/167, 121, 271/145

(56) References Cited

U.S. PATENT DOCUMENTS 3,640,524 A * 2/1972 Fredrickson ..... 271/121
6,523,820 B2 * 2/2003 Gustafson et al. ..... 271/10.01

FOREIGN PATENT DOCUMENTS

JP 55-105260 8/1980
JP 58-202228 11/1983
JP 02-193834 7/1990
JP 09-040200 2/1997
JP 2002-128283 5/2002
JP 2002-187629 7/2002

OTHER PUBLICATIONS

Office Action issued on Feb. 15, 2005, from the Japanese Patent Office with respect to Japanese Patent Application No. 2003-169228, filed on Jun. 13, 2003.
Office Action issued on Jan. 7, 2005, from the Chinese Patent Office with respect to Chinese Patent Application No. 03147524.8, filed on Jul. 9, 2003.

* cited by examiner

*Primary Examiner*—Donald P. Walsh
*Assistant Examiner*—Kaitlin Joerger
(74) *Attorney, Agent, or Firm*—Staas & Halsey LLP

(57) ABSTRACT

A paper feeding apparatus in an image forming apparatus including a paper-entering angle varying portion disposed in a frame to vary the angle of a leading end of a sheet entering a paper separating member according to the thickness or stiffness of the paper being fed. The paper-entering angle varying portion includes a paper leading end bending guide formed on the bottom surface of the frame in which paper is stacked. The paper feeding apparatus can prevent a paper feed problem, for example, multi sheet feed or a sheet feed failure by varying the paper-entering angle using the paper leading end bending guide when the paper is picked up according to the stiffness of the paper being fed.

16 Claims, 4 Drawing Sheets

PAPER-FEEDING APPARATUS HAVING A PART TO VARY A PAPER-ENTERING ANGLE IN AN IMAGE FORMING APPARATUS

CROSS-REFERENCE TO RELATED APPLICATIONS

This application claims the benefit of Korean Application No. 2002-54351, filed Sep. 9, 2002, in the Korean Intellectual Property Office, the disclosure of which is incorporated herein by reference.

BACKGROUND OF THE INVENTION

1. Field of the Invention

The present invention relates to a paper-feeding apparatus of an image forming apparatus, i.e., an office machine such as a copier, a printer or a fax machine, and more particularly, to a paper-feeding apparatus of an image forming apparatus having a part to vary a paper-entering angle to prevent a sheet pickup problem. Examples of the pickup problem are multi sheet feed or a sheet feed failure. These problems may be overcome by varying the angle of the leading end of a sheet touching the paper separating member. Specifically, the problems may be overcome by varying the angle of the leading end of a sheet entering the paper separating member according to the thickness or stiffness of the paper being fed.

2. Description of the Related Art

An image forming apparatus, i.e., an office machine, such as a printer or a fax machine, generally includes a paper-feeding apparatus feeding sheets of paper to an image forming unit.

As shown in FIG. 1, such a paper-feeding apparatus 10 includes a frame 11 forming a stacker or a tray to stack paper, a pickup unit 30 disposed at the lower side of the frame 11 (right hand side of FIG. 1) to rotate in association with a power transferring gear train (not shown) connected with a pickup roller driving motor (not shown) and to pick up sheets of paper stacked in the frame 11. The apparatus 10 also includes a paper separating assembly (not shown) including a plurality of paper separating members 40 (only one is shown) integrally or separately disposed to the frame 11 at the lower side of the frame 11 to separate and feed one sheet of paper at a time while supporting the sheet of paper to enter at a predetermined angle. A rigid bottom portion 20 of the frame 11 supports the paper separating members 40.

The pickup unit 30 includes a pickup roller assembly 33 including a pickup shaft 31 connected to the power transferring gear train, a first gear (not shown) formed around the pickup shaft 31, and first and second idle gears (not shown) pivotably disposed around first and second idle shafts 37, 38 to move in association with the first gear, and a pickup roller gear (not shown) connected to the second idle gear. The pickup unit 30 further includes a unidirectional power transfer unit (not shown) such as a spring clutch to transfer rotational power only in the paper pickup direction between the pickup roller gear and the pickup roller 34, and a link member 36 with one end connected with the pickup roller 34 to support the pickup roller 34 to be in contact with paper, and the other end pivotably supported by a supporting shaft 35.

Hereinafter, the operation of the conventional paper-feeding apparatus 10 having the above structure will be described.

When a paper feed mode is selected, the pickup shaft 31 rotates in the pickup direction, for example, clockwise, by the power transferring gear train connected to the pickup roller driving motor, and accordingly the pickup roller 34 rotates counter-clockwise in association with the first gear, the first and second idle gears and the pickup roller gear.

As a result, a sheet of paper in contact with the pickup roller 34 is picked up and fed as the pickup roller 34 rotates counter-clockwise.

The paper picked up by the pickup roller 34 is separated sheet by sheet while being supported at a predetermined angle by the paper separating member 40 of the paper separating assembly and then conveyed to an image forming unit (not shown).

After that, when the paper activates a paper sensor (not shown), a control unit (not shown) stops the pickup roller driving motor and starts a convey roller driving motor (not shown), or transfers the driving force of the pickup roller driving motor to a convey roller driving unit (not shown), thereby driving a convey roller (not shown) through a power connection/blocking device such as a swing gear (not shown) in order to stop the pickup roller 34 and drive the convey roller (not shown) to convey the paper.

As a result, the paper is continuously conveyed to the image forming unit by the convey roller. The pickup roller 34 receiving counter-clockwise rotational force from the paper idly rotates without transferring rotational force to the pickup roller gear due to the unidirectional power transfer unit of the pickup roller assembly 33.

However, in order to support the paper to enter at the predetermined angle, the conventional paper-feeding apparatus 10 has the paper separating member 40 disposed to adjust the paper entering angle based on a type of paper having a commonly used thickness.

Accordingly, if the paper being fed to the paper-feeding apparatus 10 is thicker than the common paper, for example, photo paper, the paper-entering angle of the paper separating member 40 becomes not suitable for the photo paper.

If the paper-entering angle of the paper separating member 40 is not suitable for the photo paper, a sheet pickup problem such as multi sheet feed or a sheet feed failure may occur.

SUMMARY OF THE INVENTION

Accordingly, is an aspect of the present invention to solve at least the above problems and/or disadvantages and to provide at least the advantages described hereinafter.

Additional aspects and advantages of the invention will be set forth in part in the description which follows and, in part, will be obvious from the description, or may be learned by practice of the invention.

The foregoing and/or other aspects may be achieved by providing a paper feeding apparatus in an image forming apparatus having a paper-entering angle varying portion which can prevent a paper feed problem, for example, a multi sheet feed or a sheet feed failure by varying the angle of the leading end of a sheet entering the paper separating member according to the thickness or stiffness of the paper being fed.

The foregoing and/or other aspects and advantages may be realized by providing a paper feeding apparatus of an image forming apparatus including a frame forming a paper stacker or a paper feed tray to stack paper; a pickup portion disposed above the frame and comprising a pickup roller to pick up the paper; a paper separating member disposed relative to the frame to separate and feed one sheet of the papers at a time while supporting a leading end of the sheet to enter at a predetermined angle; and a paper-entering angle varying portion provided to the frame to vary an angle of the leading end of the sheet entering the paper separating member according to a thickness and stiffness of the paper when the paper is picked up.

The paper-entering angle varying portion may include a paper leading end bending guide formed on a bottom surface of the frame on which the leading end of the sheet is stacked.

The paper leading end bending guide may include a shaft, and the paper leading end bending guide may include a declining surface declined downward at a predetermined angle with respect to a horizontal plane created by the bottom surface of the frame between a position on the horizontal plane moved from a point meeting a vertical line extending from a center of the shaft of the pickup roller towards a rear side of the sheet by a predetermined distance, and a position on which the paper separating member is disposed.

The predetermined distance and the predetermined angle may be 5 mm and 5°, respectively. In addition, an angle between the bottom surface of the frame and the paper separating member may be 113.5° and an angle between the declining surface and the paper separating member may be 108.5° in order to maintain an angle of the leading end of the sheet entering the paper separating member between 113.5° and 108.5°.

Alternatively, the paper leading end bending guide may include a groove formed on the bottom surface of the frame below the pickup roller.

The groove may be formed by an elongated recess extended at least from a position meeting the vertical line extended from a center of a shaft of the pickup roller to a position on which the paper separating member is disposed. Additionally, the groove may have a depth formed for the horizontal plane forming the bottom surface of the frame to be at approximately 5° with respect to a diagonal line of the groove in a paper-feeding direction.

Selectively, the groove may be extended from a position moved from the point meeting a vertical line extended from a center of a shaft of the pickup roller towards a rear side of the sheet by a predetermined distance to the position on which the paper separating member is disposed.

The groove may include an inclining portion inclined at a predetermined angle at least a portion between the position moved away by a predetermined distance towards the rear side of the sheet and the position on which the paper separating member is disposed in order to prevent the sheet from abruptly being bent by a normal reaction. The predetermined distance and the predetermined angle may be 5 mm and 5°, respectively.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
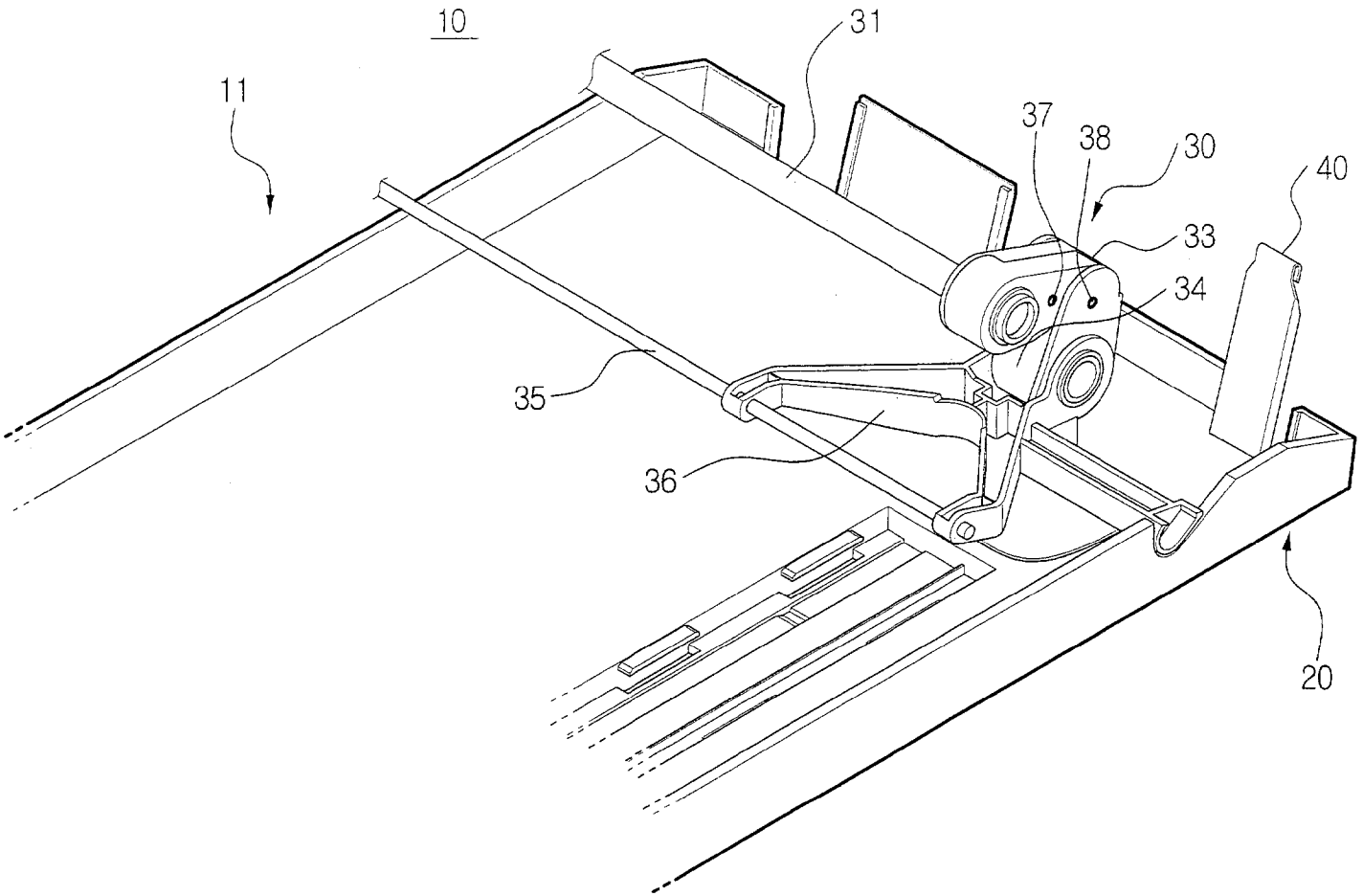
FIG. 1 (PRIOR ART)
FIG. 1 is a partial perspective view of a conventional paper-feeding apparatus.

Reference will now be made in detail to the present preferred embodiments of the present invention, examples of which are illustrated in the accompanying drawings, wherein like reference numerals refer to like elements throughout.

Figure 2:
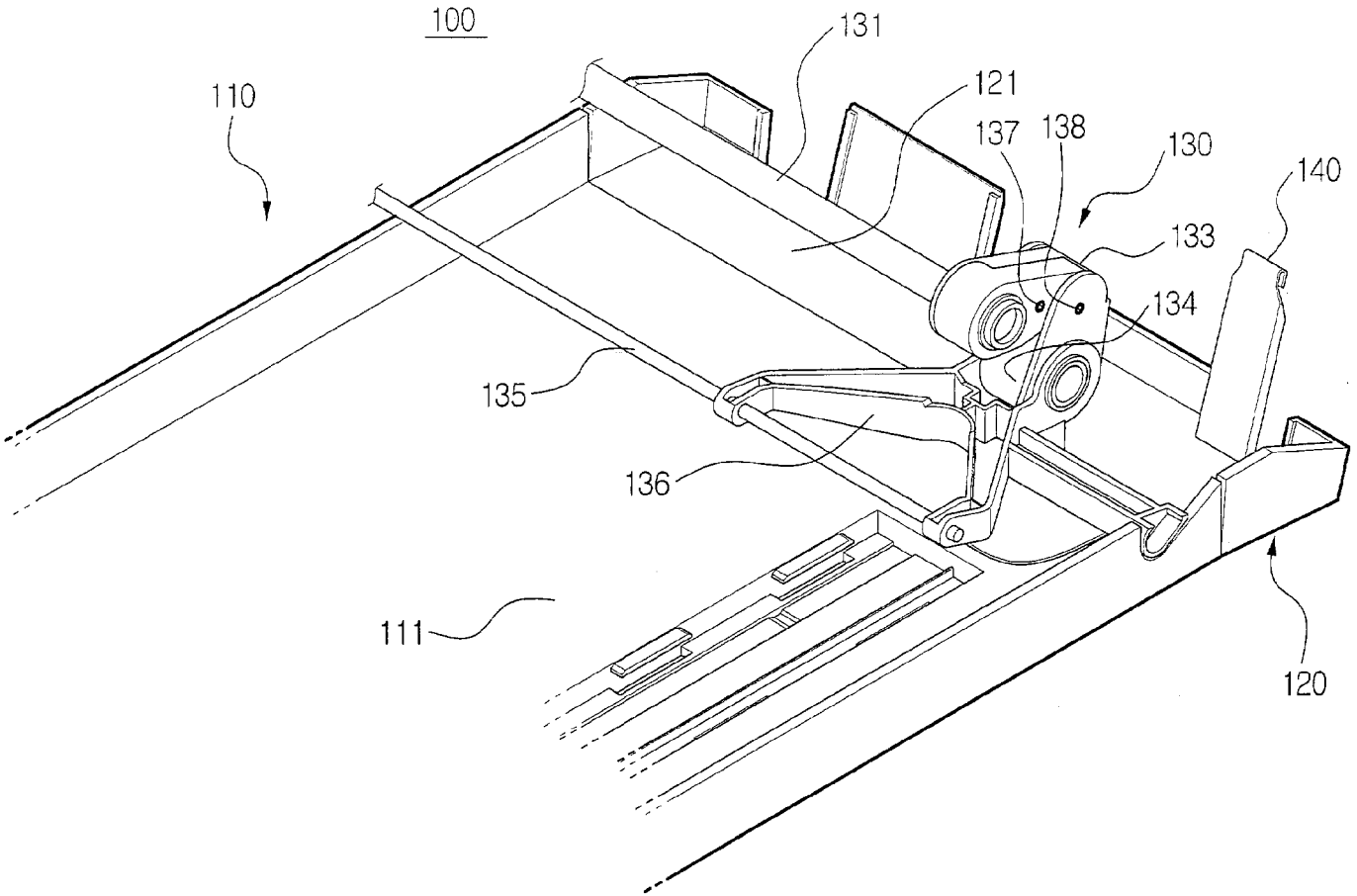
FIG. 2 is a partial perspective view of a paper-feeding apparatus of an image forming apparatus having a part for varying a paper-entering angle according to an embodiment of the present invention.

FIG. 2 illustrates a first embodiment of the present invention. A paper-feeding apparatus 100 of an image forming apparatus having a part for varying a paper-entering angle according to a first embodiment of the present invention is illustrated.

As the paper-feeding apparatus 10 shown in FIG. 1, the paper-feeding apparatus 100 according to the first embodiment of the present invention includes a frame 110 including a stacker or a tray to stack paper, a pickup unit 130 disposed at the lower side of the frame 110 (right hand side of FIG. 2) to rotate in association with a power transferring gear train (not shown) connected with a pickup roller driving motor (not shown) and to pick up sheets of paper stacked in the frame 110, and a paper separating assembly (not shown) including a plurality of paper separating members 140 (only one is shown) integrally or separately disposed to the frame 110 at the lower side of the frame 110 to separate and feed one sheet of paper at a time while supporting the sheet of paper to enter at a predetermined angle.

The pickup unit 130 includes a pickup roller assembly 133 including a pickup shaft 131 connected to the power transferring gear train, a first gear (not shown) formed around the pickup shaft 131, and first and second idle gears (not shown) pivotably disposed around first and second idle shafts 137, 138 to move in association with the first gear, and a pickup roller gear (not shown) connected to the second idle gear. The pickup unit 130 further includes a unidirectional power transfer unit (not shown) such as a spring clutch to transfer rotational power only in the paper pickup direction between the pickup roller gear and the pickup roller 134, and a link member 136 with one end connected with the pickup roller 134 to support the pickup roller 134 to be in contact with paper, and the other end pivotably supported by a supporting shaft 135.

A paper-entering angle varying portion 120 is provided at the lower part of a bottom surface 111 of the frame 110 in which paper is stacked to vary the angle of paper entering the paper separating member 140 according to the thickness and stiffness of the paper when the paper is picked up.

The paper-entering angle varying portion 120 includes a paper leading end bending guide 121 to guide the leading end of the paper to bend at an angle corresponding to the thickness of the paper.

Figure 3:
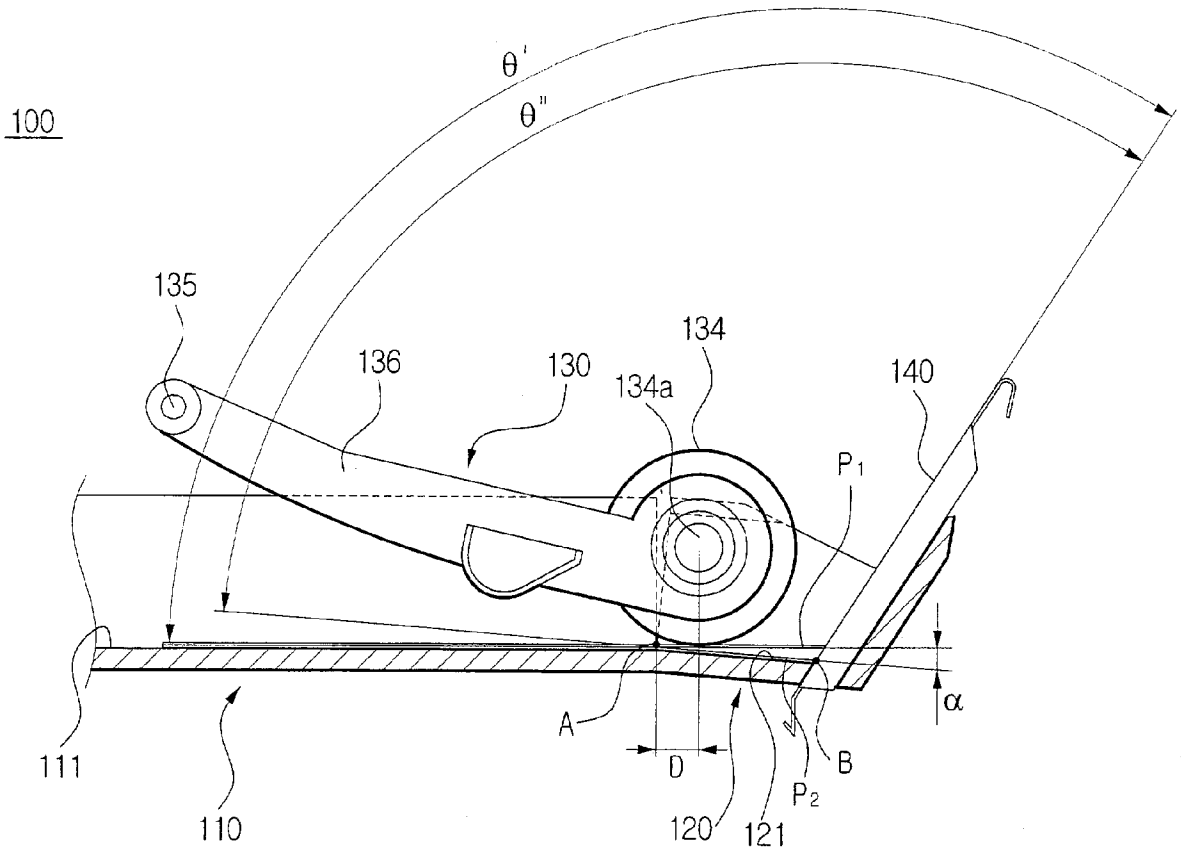
FIG. 3 is a side sectional view of the paper-feeding apparatus shown in FIG. 2.

As shown in FIG. 3, the paper leading end bending guide 121 is formed of a declining surface that is declined downward at a predetermined angle $\alpha$, for example, 5° with respect to the horizontal plane created by the bottom surface 111 of the frame 110 between position A on the horizontal plane moved from the point meeting the vertical line extended from the center of a shaft 134*a* of the pickup roller 134 towards the rear side of the paper P1, P2 by a predetermined distance D, for example, approximately 5 mm, and position B on which the paper separating member 140 is disposed.

Accordingly, when thick sheets of paper P1 such as photo paper are stacked on the bottom surface 111 of the frame 110, the leading end of the thick sheets of paper P1 are at an angle, i.e., a first paper entering angle θ' appropriate for being separated by its own stiffness, with respect to the paper separating member 140. The first paper entering angle θ' is 113.5°.

Alternatively, when thin sheets of paper P2 such as general printing paper are stacked on the bottom surface 111 of the frame 110, the leading end of the thin sheets of paper P2 is at an angle, i.e., a second paper entering angle θ" appropriate for being separated by its own stiffness, with respect to the paper separating member 140. The second paper-entering angle θ" may be 108.50°.

Thus, a paper feed problem occurring due to the use of paper varying in thickness in the conventional paper feeding apparatus 10 having a paper entering angle fixed based on a single type of paper may be prevented since the paper feeding apparatus 100 can have different papers P1 or P2 entering at angles θ' or θ" with respect to the paper separating member 140 according to the thickness, i.e., stiffness, of paper P1 or P2.

Figure 4:
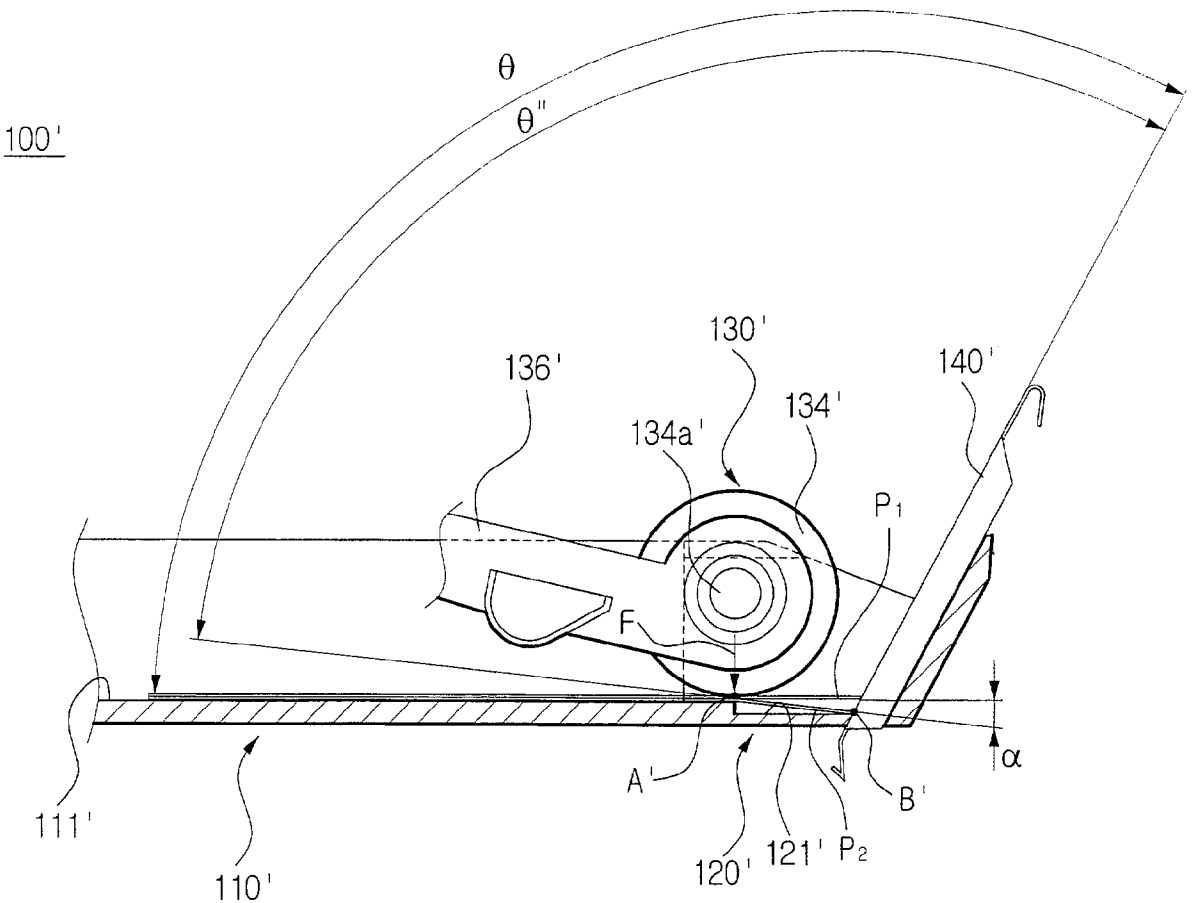
FIG. 4 is a side sectional view of a paper-feeding apparatus of an image forming apparatus having a part for varying a paper-entering angle according to another embodiment of the present invention.

Referring to FIG. 4, a paper feeding apparatus 100' according to a second embodiment of the present invention having a paper-entering angle varying portion 120' is illustrated.

The paper feeding apparatus 100' has the same structure as the paper feeding apparatus 100 shown in FIGS. 2 and 3 except that the paper-entering angle is varied not by the paper-entering angle varying portion 120 formed by an inclined surface but by a paper leading end bending guide 121' formed by a groove.

The groove forming the paper leading end bending guide 121' is formed by an elongated recess extended from position A' meeting the vertical line extended from the center of the shaft 134*a*' of the pickup roller 134' to position B' on which the paper separating member 140' is disposed.

The paper leading end bending guide 121' is formed from the position A' meeting the vertical line extending from the center of the shaft 134*a*' of the pickup roller 134' because the normal reaction F generated from the pickup roller 134' when the pickup roller 134' picks up a sheet of paper is not directly applied to the paper P1, P2.

The position A' may be determined at the position moved from the point meeting the vertical line extended from the center of the shaft 134*a*' of the pickup roller 134' towards the rear side of the paper P1, P2 by a predetermined distance D, which may be approximately 5 mm, as the paper leading end bending guide 121 shown in FIGS. 2 and 3. In this case, at least between the position A' meeting the vertical line extended from the center of the shaft 134*a*' of the pickup roller 134' and the position approximately 5 mm moved towards the rear side of the paper P1, P2 forms an inclining portion (not shown) inclined downward by a predetermined angle, i.e., approximately 5°, in order to prevent paper from abruptly being bent by the normal reaction F.

In addition, the elongated recess forming the paper leading end bending guide 121' has a depth formed for the horizontal plane forming the bottom surface 111' of the frame 110' to be at approximately 5° with respect to a diagonal line of the recess in a paper-feeding direction.

Therefore, when thick sheets of paper P1 or thin sheets of paper P2 are stacked on the bottom surface 111' of the frame 110', the leading end of the thick sheets of paper P1 or the thin sheets of paper P2 are at the first or second paper entering angle θ' or θ" respectively, i.e., 113.5° or 108.5°, which is appropriate for separating the thick or thin sheets of paper by their own stiffness.

The operation of the paper feeding apparatuses 100, 100' in an image forming apparatus according to the embodiments of the present invention having the above described structure will not be described again as it is same as the conventional paper feeding apparatus 10 .

As described above, the paper feeding apparatus in an image forming apparatus having the paper-entering angle varying portion according to the embodiment of the present invention can prevent a sheet pickup problem, for example, multi sheet feed or a sheet feed failure by varying the angle of the leading end of a sheet entering the paper separating member according to the thickness or stiffness of the paper being fed.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A paper feeding apparatus of an image forming apparatus comprising:

a frame forming a paper stacker or a paper feed tray to stack papers;

a pickup portion disposed above the frame and comprising a pickup roller to pick up the stacked papers;

a paper separating member disposed relative to the frame to separate and feed one sheet of the picked up papers at a time while supporting a leading end of the fed sheets to enter the paper separating member at a predetermined angle; and a paper-entering angle varying portion provided to the frame to vary the angle of the leading end of the sheets entering the paper-separating member according to a thickness and stiffness of the papers when the paper is picked up, wherein the paper-entering angle varying portion comprises a paper leading end bending guide formed on a bottom surface of the frame on which the leading end of the sheets are stacked, and the pickup roller comprises a shaft and the paper leading end bending guide comprises a declining surface declined downward at a predetermined angle with respect to a horizontal plane created by the bottom surface of the frame between a position on the horizontal plane moved from a point meeting a vertical line extending from a center of the shaft of the pickup roller towards a rear side of the sheet by a predetermined distance, and a position on which the paper separating member is disposed.

2. The paper feeding apparatus of an image forming apparatus according to claim 1, wherein the predetermined distance and the predetermined angle are 5 mm and 5° respectively.

3. The paper feeding apparatus of an image forming apparatus according to claim 2, wherein an angle between the bottom surface of the frame and the paper separating member is 113.5° and an angle between the declining surface and the paper separating member is 108.5° in order to maintain the angle of the leading end of the sheet entering the paper separating member between 113.5° and 108.5°.

4. The paper feeding apparatus of an image forming apparatus according to claim 1, wherein the paper leading end bending guide comprises a groove formed on the bottom surface of the frame below the pickup roller.

5. The paper feeding apparatus of an image forming apparatus according to claim 4, wherein the pickup roller comprises a shaft and the groove is formed by an elongated recess extending from a position meeting a vertical line extending from a center of the shaft of the pickup roller to a position on which the paper separating member is disposed.

6. The paper feeding apparatus of an image forming apparatus according to claim 5, wherein the groove has a depth so that a horizontal plane forming the bottom surface of the frame is approximately 5° with respect to a diagonal line of the groove in a paper-feeding direction.

7. The paper feeding apparatus of an image forming apparatus according to claim 4, wherein the pickup roller comprises a shaft and the groove is extended from a position moved from a point meeting a vertical line extending from a center of the shaft of the pickup roller towards a rear side of the sheets by a predetermined distance to a position on which the paper separating member is disposed.

8. The paper feeding apparatus of an image forming apparatus according to claim 7, wherein the groove comprises an inclining portion inclined at a predetermined angle with respect to a portion between a position moved away by a predetermined distance towards a rear side of the sheets and a position on which the paper separating member is disposed in order to prevent the sheets from abruptly being bent by a normal force of the pickup roller.

9. The paper feeding apparatus of an image forming apparatus according to claim 8, wherein the predetermined distance and the predetermined angle are 5 mm and 5° respectively.

10. An apparatus comprising:

a paper-separating member to separate and feed papers and to support a leading end of the papers while entering the paper-separating member;

a paper-entering angle varying portion to vary an angle of the leading end of the papers entering the paper separating member according to a thickness and stiffness of the papers;

a frame, the papers being stacked in the frame; and a pickup roller to pick up the stacked papers and pass the picked up papers to the paper-separating member.

wherein the paper-entering angle varying portion comprises an end to bend the leading end of the papers at an angle corresponding to the thickness of the papers, and the pickup roller comprises a shaft and the end of the paper-entering angle varying portion comprises a declining surface declined downward at a predetermined angle with respect to a horizontal plane created by a bottom surface of the frame between a position on the horizontal plane moved from a point meeting a vertical line extending from a center of the shaft of the pickup roller towards a rear side of the respective papers by a predetermined distance, and a position on which the paper separating member is disposed.

11. The apparatus according to claim 10, wherein the papers are fed one at a time.

12. The apparatus according to claim 10, wherein the end of the paper-entering angle varying portion is angled away from the pickup roller relative to the frame.

13. The apparatus of claim 12, wherein an angle formed between the frame and the end of the paper-entering angle varying portion is 5 degrees.

14. The apparatus of claim 13, wherein the angle of the leading end of the papers entering the paper separating member decreases as the stiffness of the papers increases.

15. The apparatus of claim 13, wherein the angle of the leading end of the papers entering the paper separating member increases as the stiffness of the papers decreases.

16. An apoaratus comprising:

a paper separating member to separate and feed papers and to support a leading end of the papers while entering the paper separating member; and a paper-entering angle varying portion to vary an angle of the leading end of the papers entering the paper separating member according to a thickness and stiffness of the papers;

a frame, the papers being stacked in the frame; and a pickup roller to pick up the stacked papers and pass the picked up papers to the paper-separating member, wherein the paper-entering angle varying portion comprises a groove formed in the frame.

* * * * *

UNITED STATES PATENT AND TRADEMARK OFFICE

CERTIFICATE OF CORRECTION

PATENT NO. : 6,969,063 B2
APPLICATION NO. : 10/424942
DATED : November 29, 2005
INVENTOR(S) : Ju-hyun Park It is certified that error appears in the above-identified patent and that said Letters Patent is hereby corrected as shown below:

Column 7, line 40, claim 10, replace “member.” with --member,--, therefor;

Column 8, line 28, claim 16, replace “apoaratus” with --apparatus--, therefor.

Signed and Sealed this

Eleventh Day of July, 2006

JON W. DUDAS
*Director of the United States Patent and Trademark Office*